US010827805B2

(12) United States Patent
Schulten-Gaywood

(10) Patent No.: US 10,827,805 B2
(45) Date of Patent: Nov. 10, 2020

(54) EQUESTRIAN LEGWEAR WITH ADJUSTABLE SPUR HOLDER

(71) Applicant: Nicola Veronica Schulten-Gaywood, Rockford, MI (US)

(72) Inventor: Nicola Veronica Schulten-Gaywood, Rockford, MI (US)

( * ) Notice: Subject to any disclaimer, the term of this patent is extended or adjusted under 35 U.S.C. 154(b) by 74 days.

(21) Appl. No.: 15/819,739

(22) Filed: Nov. 21, 2017

(65) Prior Publication Data

US 2018/0271220 A1 Sep. 27, 2018

Related U.S. Application Data

(60) Provisional application No. 62/497,547, filed on Nov. 22, 2016.

(51) Int. Cl.

| | |
|---|---|
| ***A43B 5/00*** | (2006.01) |
| ***A43C 17/02*** | (2006.01) |
| ***A43C 17/04*** | (2006.01) |
| ***A41D 1/086*** | (2018.01) |
| ***A41D 17/00*** | (2006.01) |

(52) U.S. Cl.

CPC ..... *A43C 17/02* (2013.01); *A41D 1/086* (2013.01); *A41D 17/005* (2013.01); *A43B 5/006* (2013.01); *A43C 17/04* (2013.01); *A41D 2600/10* (2013.01)

(58) Field of Classification Search

CPC ..... A43B 5/006; A41D 1/086; A43C 17/00; A43C 17/02; A43C 17/04; A43C 17/06

USPC ..... 36/74, 131, 1.5, 2 R, 2 A, 2 B

See application file for complete search history.

(56) References Cited

U.S. PATENT DOCUMENTS

| | | | | |
|---|---|---|---|---|
| 1,665 A | | 7/1840 | Warner | |
| 3,142 A | | 6/1843 | Reinhardt | |
| 32,490 A | | 6/1861 | Towers | |
| 39,106 A | | 6/1863 | Langholz | |
| 78,667 A | | 6/1868 | Herr | |
| 82,921 A | | 10/1868 | Cooper | |
| 113,152 A | | 3/1871 | Fellows | |
| 116,404 A | | 6/1871 | Bohn | |
| 193,342 A | | 7/1877 | Mills | |
| 308,413 A | | 11/1884 | Kaino | |
| 376,832 A | | 1/1888 | Schummel | |
| 225,955 A | | 3/1888 | Tytler | |
| 450,512 A | | 4/1891 | Hutt | |
| 635,948 A | | 9/1899 | Turpin | |
| 694,421 A | | 3/1902 | Ridings | |
| 701,854 A | | 6/1902 | Davidson | |
| 702,476 A | | 6/1902 | Price | |
| 722,046 A | | 3/1903 | Rieger | |
| 740,226 A | * | 9/1903 | Brown | A43C 17/00 54/83.1 |
| 973,367 A | | 10/1910 | McKinney | |
| 1,006,501 A | | 10/1911 | Ptaschinski | |

(Continued)

FOREIGN PATENT DOCUMENTS

FR 3025701 A1 * 3/2016 ..... A43C 17/02

*Primary Examiner* — Sharon M Prange

(74) *Attorney, Agent, or Firm* — Frank M. Scutch, III

(57) ABSTRACT

The invention is an improved method and apparatus for securing a riding spur to an equestrian legwear garment such as a chap or boot, wherein the spur can be quickly and easily attached, adjusted, or removed by a rider without dismounting the horse. Additionally, the invention can be configured so that the chap or boot may be removed from the wearer without first having to remove the spur.

17 Claims, 6 Drawing Sheets

(56) References Cited

U.S. PATENT DOCUMENTS

| | | | | |
|---|---|---|---|---|
| 1,076,845 | A | 10/1913 | Shiverick | |
| 1,078,109 | A | 11/1913 | Reynolds | |
| 1,155,506 | A | 10/1915 | Osaki | |
| 1,351,619 | A | 8/1920 | Calderon | |
| 1,686,604 | A | 9/1928 | Blair | |
| 1,882,059 | A | 10/1932 | Boos | |
| 2,068,811 | A | 1/1937 | McCory | |
| 2,098,017 | A | 11/1937 | Seyfarth | |
| 2,132,066 | A | 10/1938 | Alesci | |
| 2,290,445 | A | 7/1942 | Oleyar | |
| 2,438,978 | A | 4/1947 | Rossen | |
| 2,454,228 | A | 11/1948 | Smith | |
| 2,487,461 | A | 11/1949 | Mckinney | |
| 3,153,864 | A | 10/1964 | Brewer | |
| 3,157,013 | A | 11/1964 | Hayward | |
| 3,269,036 | A | 8/1966 | Parker | |
| 3,296,667 | A * | 1/1967 | Streule | A43C 11/14 24/68 SK |
| 3,654,670 | A * | 4/1972 | Baso | A43C 11/1413 24/70 SK |
| 4,348,854 | A | 9/1982 | Van Scoyk | |
| 4,443,996 | A | 4/1984 | Welton | |
| 4,506,391 | A | 3/1985 | Rodman | |
| 4,513,561 | A | 4/1985 | Welton et al. | |
| 4,642,910 | A | 2/1987 | Carter | |
| 5,033,124 | A | 7/1991 | Bucalo | |
| 5,033,126 | A | 7/1991 | Wruck | |
| D352,805 | S | 11/1994 | Martin | |
| 5,394,677 | A | 3/1995 | Van Scoyk | |
| 5,970,525 | A | 10/1999 | Gallinot | |
| 6,185,752 | B1 | 2/2001 | Hendersen | |
| 6,192,663 | B1 | 2/2001 | Balkenhol | |
| 6,205,686 | B1 * | 3/2001 | Davis | A43B 11/00 36/136 |
| 6,339,915 | B1 | 1/2002 | Bradbury | |
| 6,360,456 | B2 * | 3/2002 | Davis | A43B 11/00 36/136 |
| D459,558 | S | 6/2002 | Martin | |
| 6,536,196 | B2 * | 3/2003 | Harrison | A43C 17/02 54/83.1 |
| 7,310,928 | B2 | 12/2007 | Curry | |
| D581,132 | S | 11/2008 | Blue | |
| 7,836,524 | B2 * | 11/2010 | Muench | A41D 17/02 2/227 |
| 7,913,427 | B2 * | 3/2011 | Edwards | A43C 17/02 36/114 |
| 8,448,356 | B2 | 5/2013 | Edwards | |
| 9,021,721 | B2 * | 5/2015 | McCarron | A43B 5/006 36/28 |
| 10,251,441 | B2 * | 4/2019 | Benetti | A43B 5/006 |

* cited by examiner

EQUESTRIAN LEGWEAR WITH ADJUSTABLE SPUR HOLDER

CROSS-REFERENCE TO RELATED APPLICATION

This application claims priority under 35 U.S.C. § 119(e) on U.S. Provisional Application No. 62/497,547 entitled EQUESTRIAN RIDING GARMENT WITH INTEGRATED ADJUSTABLE SPUR HOLDER SYSTEM, filed Nov. 22, 2016, by Nicola Schulten-Gaywood, the entire disclosure of which is incorporated herein by reference.

FIELD OF THE INVENTION

The invention provides the user with an improved method and apparatus for attaching a riding spur to equestrian legwear such as a chap or boot, wherein the spur can be quickly and easily attached, adjusted or removed without dismounting the horse, and additionally provides the user with improved comfort and freedom of movement throughout equestrian activity.

BACKGROUND OF THE INVENTION

People have been using spurs while riding horses for many years. A spur is a device which is worn on the back of a rider's boot, on or just above the heel, and helps the rider direct a horse's movement in various ways. Some specialized spurs are permanently fixed to the boot, but most spurs are temporarily secured with a strap.

The main part of a conventional spur is a rigid U-shaped bracket, called a yoke, which wraps around the back heel area of a riding boot. A rigid protrusion, called a spur neck, is fixed to and extends backward from the center of the rear, curved portion of the yoke. The distal end of the spur neck is called a spur tip, which is the part of the spur that physically contacts the horse. Most spurs are held in place by an instep strap, which is connected to both forward, free ends of the yoke and wraps over the instep and under the sole of a boot. The instep strap holds the front part of the spur yoke in place. The rear part of the spur yoke is held in place and supported by a spur rest, which is a small lateral protuberance that extends backward from just above the heel of a riding boot. The function of the spur rest is very important, as it is intended to maintain the spur neck and spur tip in a specific position relative to the horse's anatomy. However, a common problem with this traditional method of spur attachment is the likelihood of the strap loosening during equestrian activity, which causes the rear portion of the yoke to slip down over the spur rest and drop downward, which is known as a "dropped spur".

When a spur neck shifts downward (or upward) from its correct position, the point of contact between the spur tip and the horse changes—or is eliminated altogether. This diminishes the rider's control of the animal, creating a potentially dangerous situation. Because precise placement of the spur tip against the horse's side is critical, the rider must then halt the horse, dismount and re-adjust the spur and re-tighten the strap, which is inconvenient and time-consuming. Furthermore, because the strap must be very tight to prevent the spur from shifting, the rider experiences severe discomfort on the instep of her/his foot.

Another disadvantage when utilizing a spur rest is that only one spur position is available, forcing the rider to spend quite a bit of time adjusting the length of the stirrup straps to an exact needed length. This being an undesirable situation, it would be advantageous to have a connective arrangement wherein the spur could be secured to a rider's foot more conveniently, and in a way that would prevent the spur from shifting. Also, because short and tall riders have different leg lengths, it would be beneficial if the spur neck could be easily lifted or lowered, so as to optimize vertical placement of the spur tip against the horse's body.

Many chaps and boots are held in place on the wearer's leg or foot by a vertical zipper which extends from the top to the bottom of a chap or boot, resulting in yet another inconvenience from using an instep strap: the necessity of having to completely remove the spur before removing the rider's chap or boot.

Thus, there is a need for a new convenient, easy, improved method of securely attaching a riding spur to a chap or boot without using an instep strap, wherein the vertical position of the spur tip can be quickly and easily changed, and without the need for removing the spur in order to remove the chap or boot.

SUMMARY OF THE INVENTION

The invention satisfies the need for an improved method of securely attaching a riding spur to a chap or boot without using an instep strap, wherein the vertical position of the spur tip can be quickly and easily changed, and without having to remove the spur in order to remove the chap or boot. Additionally, the spur can be quickly and easily attached, adjusted or removed by a rider without having to dismount the horse. Elimination of a tightened instep strap also provides more comfort to the rider. Furthermore, the improved method of attachment described herein allows riders to use existing, traditional spur yokes on the market today, without the instep strap.

In an aspect of the invention, both free ends of the spur yoke are inserted into two rearward-facing pockets, located on the left and right side of a riding chap or boot, wherein the pockets firmly hold and secure the free ends of the yoke to the chap or boot. An optional design provides two or more pockets on one or both sides of a chap or boot, arranged vertically at different heights, such that a free end of the yoke can be inserted into either an upper or lower pocket in order to achieve a proper fit.

Most riding chaps and tall riding boots include a full-length vertical zipper, requiring the user to disconnect the instep strap and remove the spur before removing the chap or boot. In another aspect of the invention, by providing only one side pocket, another convenient advantage can be realized: the legwear garment can be removed from the wearer without having to remove the spur, which is accomplished by using a spur yoke wherein one of the free ends is shortened, and is not inserted into a pocket. In this arrangement, the shorter of the two free ends does not cover the vertical zipper, allowing the zipper to be completely unzipped so that the boot or chap can be removed. Instead of a pocket, a releasable fastener such as a snap may be used to secure a free end of the yoke to the left &/or right side of a chap or boot. The snap may also include a strap that can be woven through a free end of a traditional yoke. Also, two or more fasteners may be located at different heights on one or both sides, to secure the free ends of the yoke at different vertical positions.

The spur neck is held in place by a vertically positioned strap called a backstrap, which is centrally located on the lower back area of a chap or boot. On a chap, the lower end of the backstrap is attached near or at the bottom edge of the chap. On a boot, the lower end of the backstrap is attached to the boot just above the heel. On either a chap or a boot, the lower end of the backstrap may be permanently fixed or may be releasably connected via a fastener such as a snap. The backstrap includes one or more apertures through which the spur neck projects. The upper end of the backstrap is connected to a chap or boot using a releasable fastener such as a snap, which effectively secures the spur neck to the chap or boot in a desired position. By providing multiple apertures, the vertical position of a spur tip can be easily changed by using a different aperture.

Furthermore, two or more apertures may be connected to each other by one or more slits, allowing a different aperture to be accessed and used by simply pushing the spur neck up or down along a slit to engage a different aperture. The position of the spur tip can also be changed by unsnapping the upper end of the backstrap, then inserting the spur neck through a different aperture. Another function of having slits between apertures is to allow bulbous spur tips to be forced through a slit in order for the spur neck to engage a desired aperture. In some instances, two or more backstraps may be used to secure a spur in various positions.

These and other features, advantages and objects of the present invention will be further understood and appreciated by those skilled in the art by reference to the following specification, claims and appended drawings.

NOMENCLATURE OF THE DRAWINGS

1—spur neck of ½ spur
2—spur tip of ½ spur
3—long free end of ½ yoke
4—short unsecured free end of ½ yoke
5—spur ½ yoke with one short, unsecured free end
6—traditional riding boot
7—traditional chap
8—traditional spur assembly
9—free end of yoke
10—yoke
11—instep strap
12—spur neck
13—spur rest
14—spur tip
15—traditional full-length chap
16—chap with two pockets
17—stirrup
18—chap footstrap
19—tall riding boot with two pockets
20—backstrap
21—lower snap on backstrap
22—upper snap on backstrap
23—tip of rolling spur
24—vertical zipper on chap
25—single aperture
26—lower aperture
27—center aperture
28—upper aperture
29—slit
30—opening of interior (integral) pocket
31—opening of interior (integral) pocket concealed under seam
32—opening of overlaid pocket
33—overlaid pocket
34—upper overlaid pocket
35—side strap to secure free end of yoke
36—snap on side strap
37—snap on upper flap covering zipper
216—chap of 2nd embodiment
316—chap of 3rd embodiment
416—chap of 4th embodiment
516—chap of 8th embodiment (with four pockets)
616—chap of 10th embodiment
219—boot of 6th embodiment
319—boot of 7th embodiment (side strap with snap)
419—boot of 9th embodiment (with only one pocket)

DETAILED DESCRIPTION OF SPECIFIC EMBODIMENTS

Described below is an improved basic method of attaching a riding spur to an equestrian chap or boot, showing some various designs of the components used. It is understood that the different component designs and specific means of attachment illustrated in the embodiments are interchangeable between and can be incorporated into both a riding chap or a riding boot.

Figure 1:
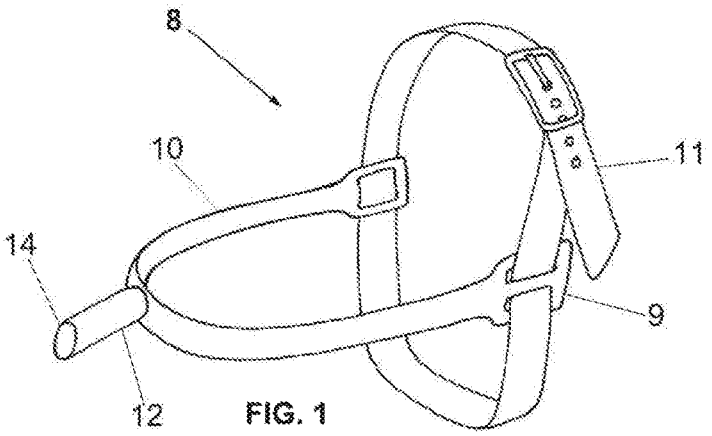
FIG. 1 (Prior art.)
FIG. 1 is a perspective view of a traditional spur assembly.

FIG. 1 shows a traditional spur assembly 8, comprised of a yoke 10 having two free ends 9 which are connected by an instep strap 11. The yoke 10 also includes a spur neck 12 and a spur tip 14.

Figure 2:
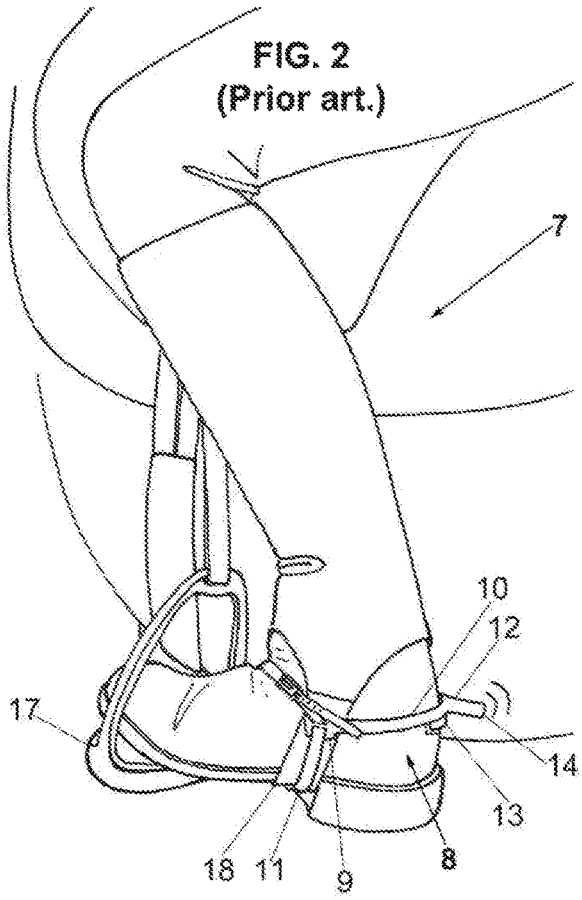
FIG. 2 (Prior art.)
FIG. 2 is a side view of a rider wearing the traditional spur assembly shown in FIG. 1, showing the rear portion of the spur yoke being supported by the spur rest, and the spur tip in contact with the horse's side.

FIG. 2 shows a leg of a mounted rider wearing a traditional riding chap 7 and a traditional riding boot 6, wherein the leg is supported by a stirrup 17. The chap 7 is held in place by a footstrap 18, which passes under the sole of boot 6 and connects to opposite lower ends of the chap 7. The rider is also wearing the traditional spur assembly 8 shown in FIG. 1, wherein the yoke 10 is secured to boot 6 by instep strap 11, which is connected to the free ends 9 of yoke 10. Note how the rear portion of yoke 10 and the spur neck 12 are supported by a spur rest 13, which projects off the back of boot 6. The spur tip 14 is shown in physical contact with the lower side of a horse.

Figure 3:
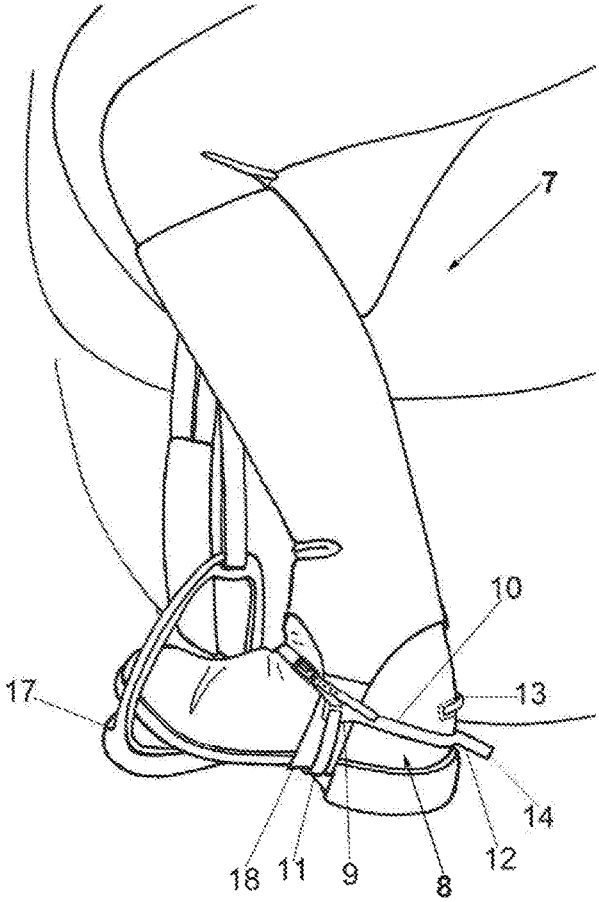
FIG. 3 (Prior art.)
FIG. 3 is a side view of a rider wearing the traditional spur assembly shown in FIG. 2, showing how the rear portion of the spur yoke has fallen off the spur rest, and the spur tip no longer in contact with the horse's side.

FIG. 3 shows the same image shown in FIG. 2, including the stirrup 17, chap 7, footstrap 18, boot 6, and traditional spur assembly 8, which is comprised of an instep strap 11, a yoke 10 with free ends 9, a spur neck 12 and spur tip 14. Note that the rear portion of yoke 10 has fallen off the spur rest 13, and as a result, the spur neck 12 and spur tip 14 are no longer in contact with the side of the horse.

Figures 4, 5, 6:
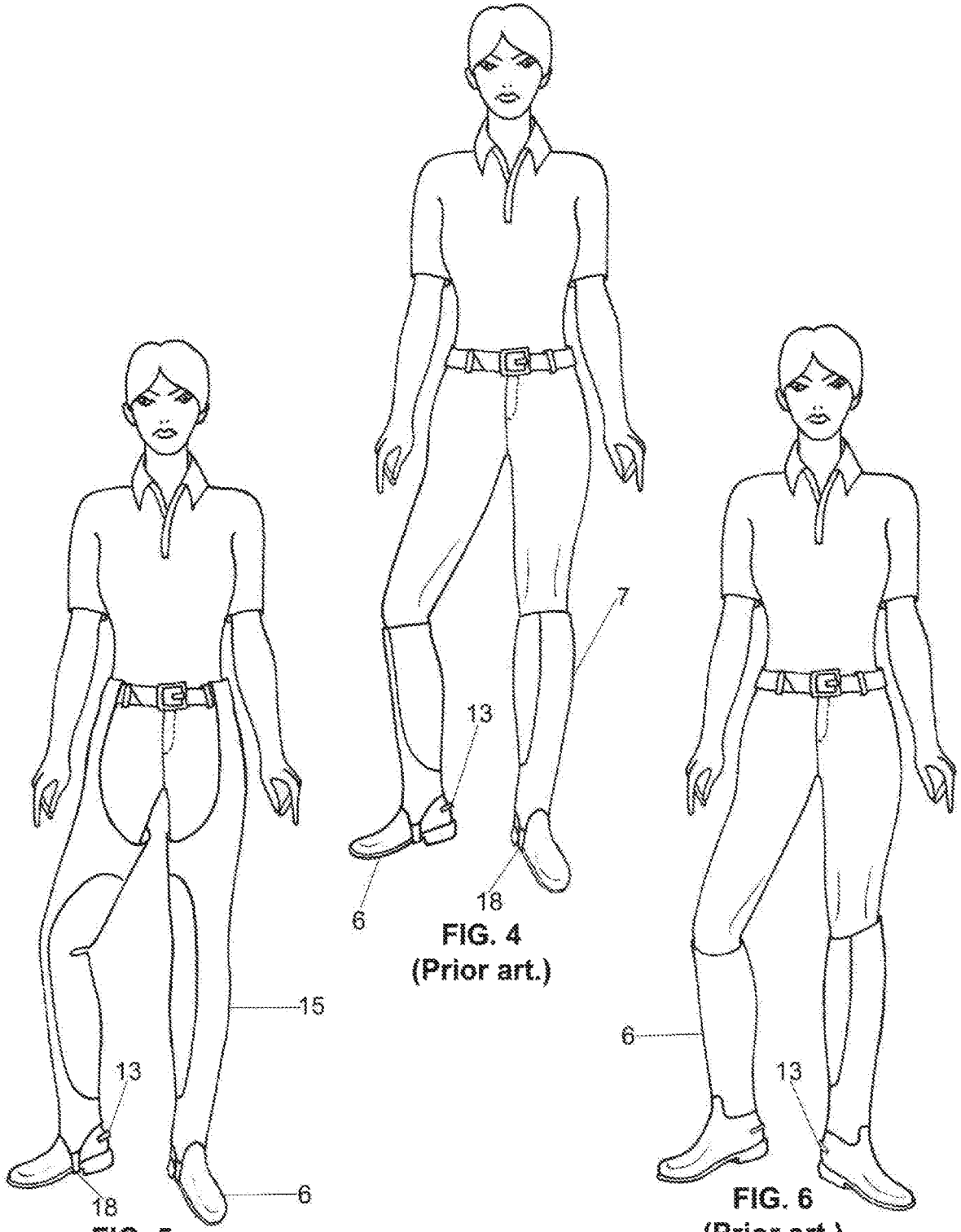
FIG. 4 (Prior art.)
FIG. 5 (Prior art.)
FIG. 6 (Prior art.)
FIG. 4 is a front view of a model wearing traditional chaps.
FIG. 5 is a front view of a model wearing traditional full-length chaps.
FIG. 6 is a front view of a model wearing traditional tall riding boots.

FIG. 4 shows a model wearing traditional riding chaps 7, which are secured to traditional riding boots 6 by footstraps 18. Each boot includes a spur rest 13, located above the heel.

FIG. 5 shows a model wearing traditional full-length riding chaps 15, which are secured to traditional riding boots 6 by footstraps 18. Each boot includes a spur rest 13, located above the heel.

FIG. 6 shows a model wearing traditional riding boots 6. Each boot includes a spur rest 13, located above the heel.

Figure 7:
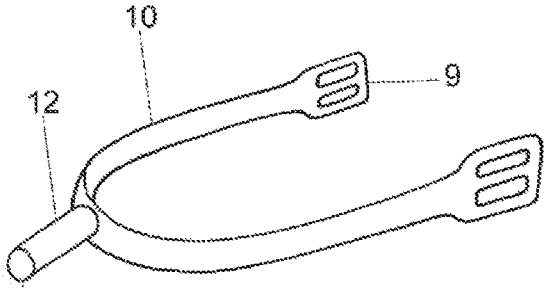
FIG. 7 (Prior art.)
FIG. 7 is a perspective view of the traditional spur yoke shown in FIG. 1, shown without the strap.

FIG. 7 shows the traditional spur yoke 10 shown in FIG. 1, without the instep strap 11.

Figure 8:
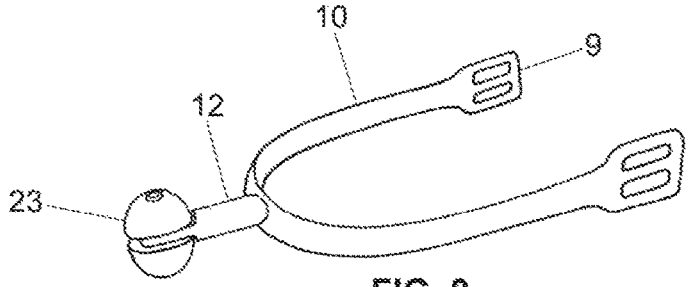
FIG. 8 (Prior art)
FIG. 8 is a perspective view of the traditional spur yoke shown in FIG. 7, having an alternative spur tip.

FIG. 8 shows the traditional spur yoke 10 shown in FIG. 7, having a roller spur tip 23.

Figure 9:
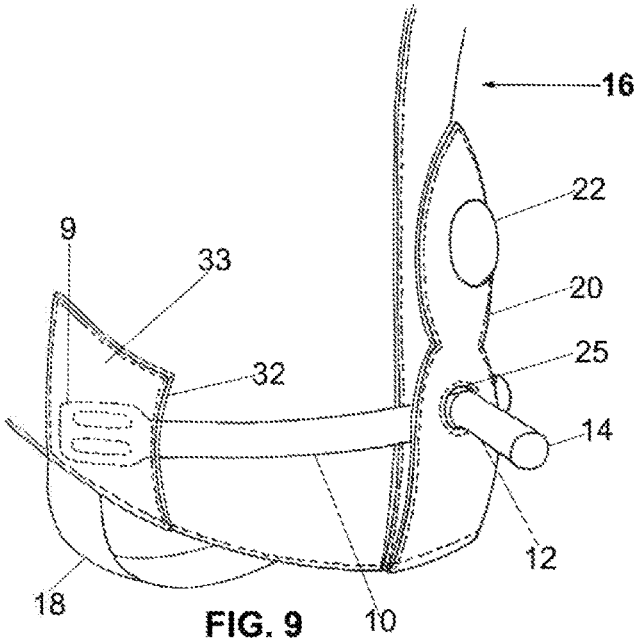
FIG. 9 is a perspective view of a chap in accordance with a first embodiment of the invention.

FIG. 9 illustrates a first embodiment of the invention, showing a lower back portion of an improved riding chap 16 which includes a footstrap 18. Shown in the drawing is an overlaid pocket 33 having a rearward-facing opening 32 into which a free end 9 of yoke 10 is inserted. The two side pockets 33 secure the front portion of yoke 10 to chap 16. The spur tip 14 and spur neck 12 protrude through an aperture 25 on backstrap 20, wherein the backstrap 20 supports and retains the rear portion of yoke 10. The lower end of backstrap 20 is sewn to the bottom of chap 16 and the upper end of backstrap 20 is releaseably fastened to chap 16 by a snap 22, allowing yoke 10 to be quickly and easily removed.

Figure 10:
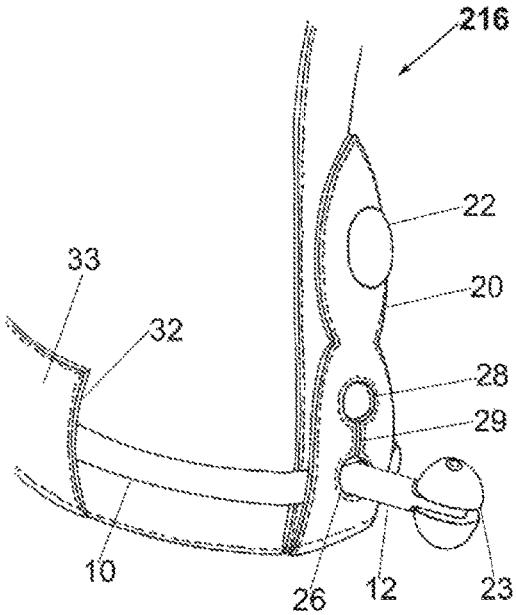
FIG. 10 is a perspective view of a chap in accordance with a second embodiment of the invention.

FIG. 10 illustrates a second embodiment of the invention, showing a lower back portion of an improved riding chap 216 which includes a footstrap 18. Overlaid pocket 33 has a rearward-facing opening 32 into which a free end 9 of yoke 10 is inserted. The two side pockets 33 secure the front portion of yoke 10 to chap 216. In this embodiment, a roller spur tip 23 is shown protruding through a lower aperture 26, which is connected to an upper aperture 28 by a slit 29, wherein the bulbous roller spur tip 23 can be forced through slit 29 and apertures 26 and 28, allowing the spur neck 12 to engage the lower aperture 26. As with all the embodiments of this invention, the backstrap 20 supports and secures the spur neck 12 and rear portion of the yoke 10, and is releasably fastened to chap 216 using a snap 22.

Figure 11:
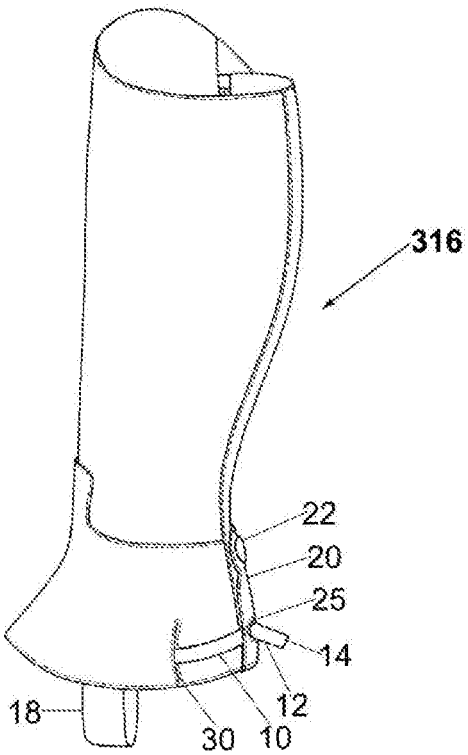
FIG. 11 is a side view of a chap in accordance with a third embodiment of the invention.

FIG. 11 illustrates a third embodiment of the invention, showing a side view of an improved riding chap 316 which includes a footstrap 18 and an opening 30 of a rearward-facing interior pocket, into which a free end 9 of yoke 10 is inserted and retained. Unlike the overlaid pocket 33 shown in FIG. 9, which is a separate piece of material that is sewn onto a large piece of material forming a side of a legwear garment, an interior pocket is integrally formed inside the aforementioned large piece of material. The backstrap 20, aperture 25, and snap 22 all cooperate to support and secure yoke 10, spur neck 12 and spur tip 14 to the chap 316.

Figure 12:
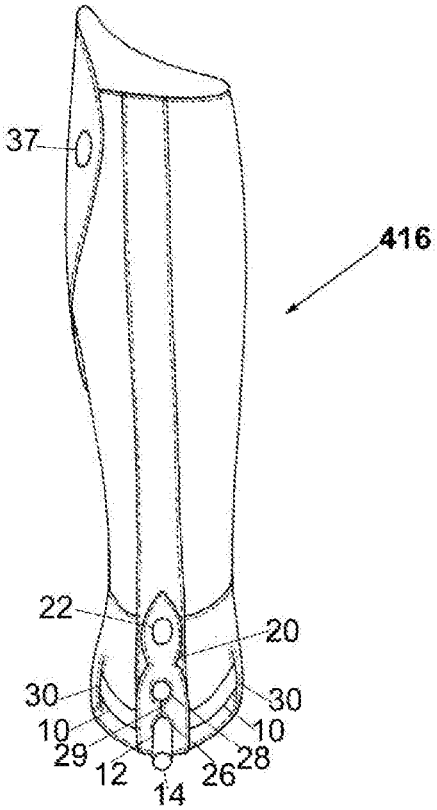
FIG. 12 is a back view of a chap in accordance with a fourth embodiment of the invention.

FIG. 12 illustrates a fourth embodiment of the invention, showing a back view of an improved riding chap 416, which is similar to chap 316 shown in FIG. 11, but includes a backstrap 20 having a lower aperture 26 and an upper aperture 28, which are connected by a slit 29. Also shown in the drawing are two interior pocket openings 30, a yoke 10 with a spur neck 12 and spur tip 14, and a snap 22 fixed to the upper end of backstrap 20. Shown near the top edge of chap 416 is a flap which is secured by a snap 37, which has nothing to do with this invention.

Figure 13:
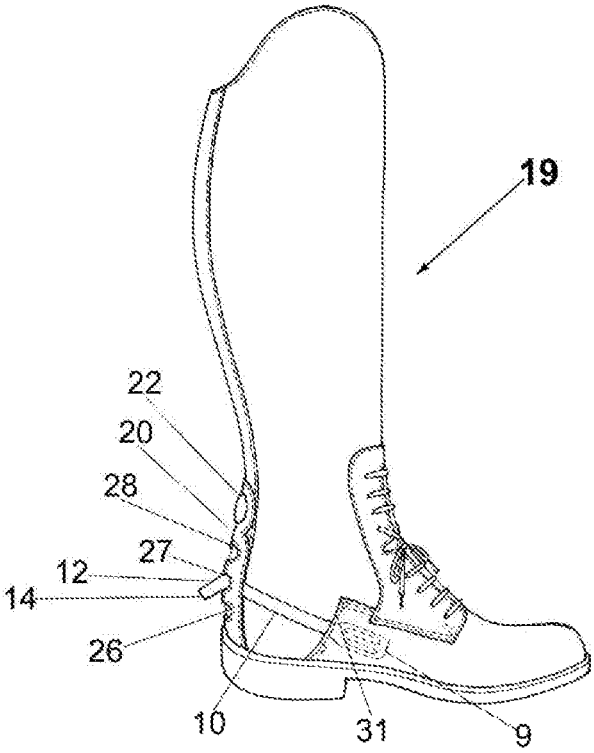
FIG. 13 is a side view of a tall riding boot in accordance with a fifth embodiment of the invention.

FIG. 13 illustrates a fifth embodiment of the invention, showing a side view of an improved tall riding boot 19. The location of one free end 9 of yoke 10 is shown inside an interior pocket having a rearward-facing opening 31 which is concealed under a structural seam of the boot. Attached to the back of the boot is a backstrap 20 having three apertures 26, 27, 28, and a snap 22. The spur neck 12 and spur tip 14 protrude through center aperture 27.

Figure 14:
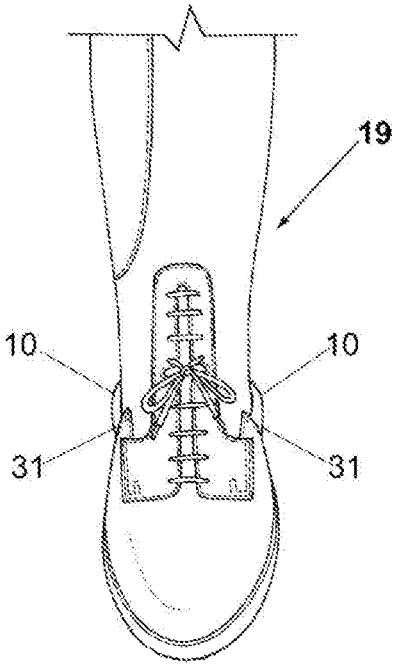
FIG. 14 is a front view of the tall riding boot shown in FIG. 13.

FIG. 14 is a front view of the improved tall riding boot 19 shown in FIG. 13, showing the yoke 10 and concealed pocket openings 31.

Figure 15:
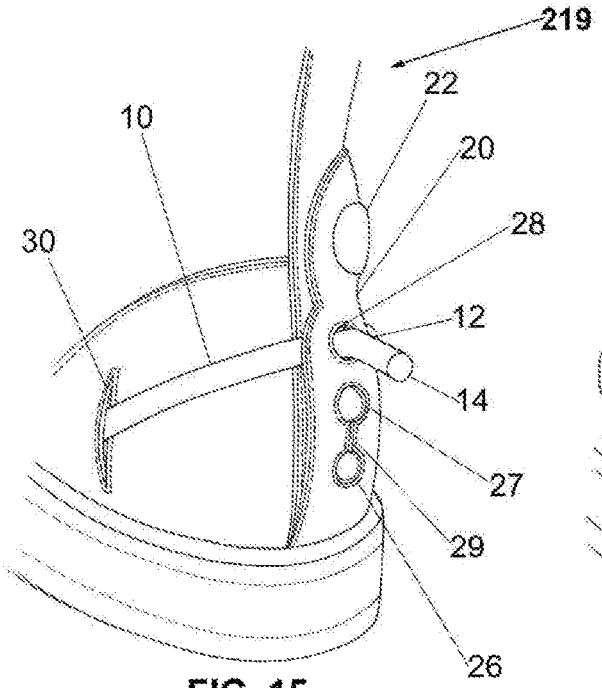
FIG. 15 is a perspective view of a boot in accordance with a sixth embodiment of the invention.

FIG. 15 illustrates a sixth embodiment of the invention, showing a lower back portion of an improved riding boot 219, with a free end 9 of the yoke 10 inserted into the opening 30 of an interior pocket, which retains the front portion of yoke 10. As shown on backstrap 20, only the lower aperture 26 and center aperture 27 are connected by a slit 29. Spur neck 12 and spur tip 14 protrude through upper aperture 28 and are secured to boot 219 by snap 22.

Figure 16:
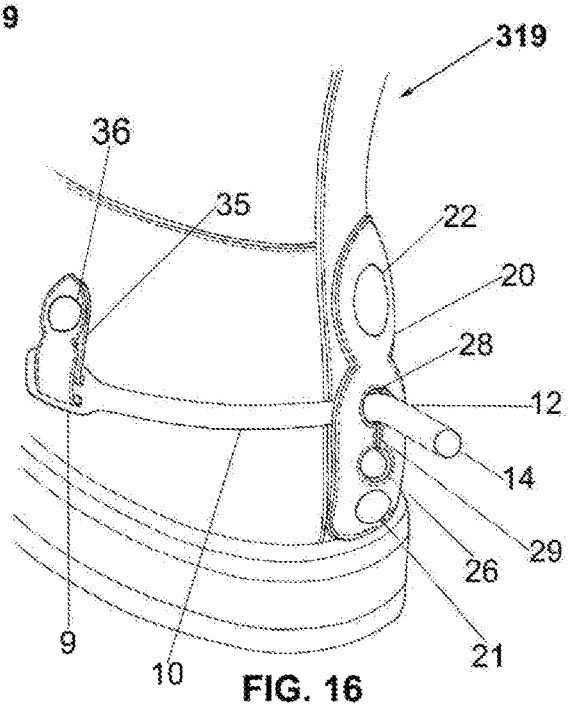
FIG. 16 is a perspective view of a boot in accordance with a seventh embodiment of the invention.

FIG. 16 illustrates a seventh embodiment of the invention, showing a lower back portion of an improved riding boot 319, wherein an alternative connective arrangement is used to secure the yoke 10 to the boot 319. Instead of being inserted into a pocket, the free end 9 of yoke 10 is supported and retained by a strap 35 and fastened to the side of boot 319 by a snap 36. A backstrap 20 includes a lower aperture 26 and an upper aperture 28, which are connected by a slit 29. The backstrap 20 supports spur neck 12 and spur tip 14, and includes an upper snap 22 and also includes a lower snap 21. This method of attachment enables both the side strap 35 and backstrap 20 to be completely removed from the boot if desired.

Figure 17:
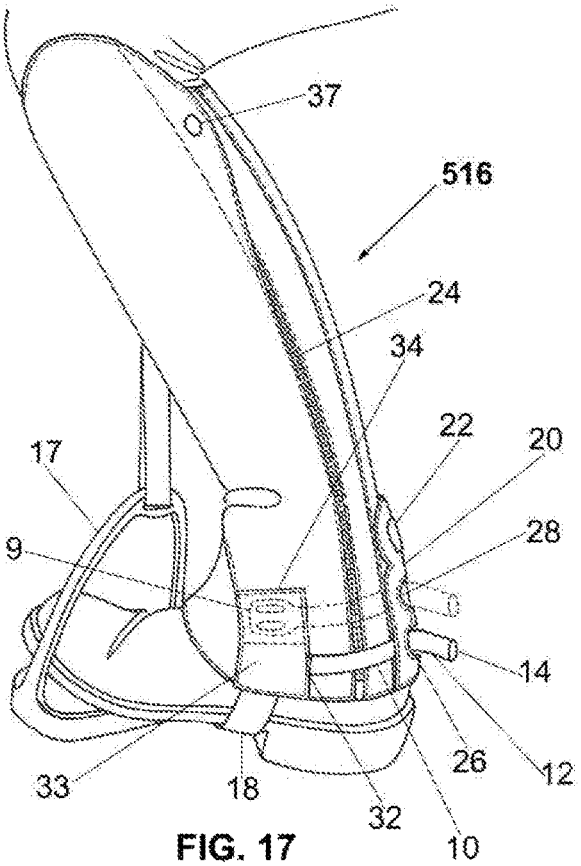
FIG. 17 is a side view of a chap in accordance with an eighth embodiment of the invention.

FIG. 17 illustrates an eighth embodiment of the invention, showing a side view of a mounted rider's lower leg covered by an improved riding chap 516, with the foot being suspended by a stirrup 17. Chap 516 includes a footstrap 18 and a vertical zipper 24 which extends from the top edge to the bottom edge of chap 516. The top end of zipper 24 is covered by a flap which is fastened by a snap 37. An upper overlaid pocket 34 is also provided, into which a free end 9 of yoke 10 may be inserted, thereby providing an elevated horizontal position for yoke 10, spur neck 12 and spur tip 14. Chap 516 is shown with a free end 9 of yoke 10 inserted into the opening 32 of lower overlaid pocket 33. The backstrap 20 includes a snap 22, a lower aperture 26 and an upper aperture 28. Spur neck 12 and spur tip 14 are shown protruding through lower aperture 26.

Figure 18:
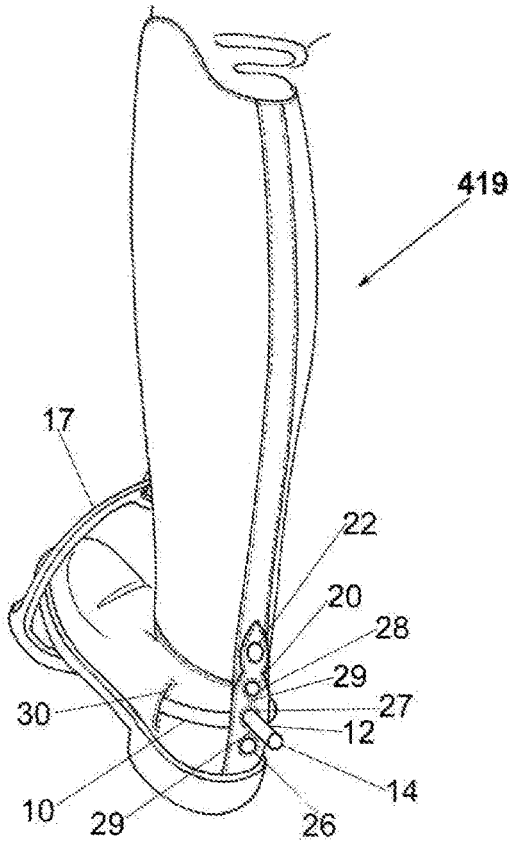
FIG. 18 is a perspective view of a tall riding boot in accordance with a ninth embodiment of the invention.

FIG. 18 illustrates a ninth embodiment of the invention, showing a rear perspective view of a mounted rider wearing an improved tall riding boot 419, which is supported by a stirrup 17. The backstrap 20 includes a snap 22 and three apertures 26, 27, 28, which are all connected by slits 29. The spur neck 12 and spur tip 14 are shown protruding through center aperture 27, and a free end 9 of yoke 10 is inserted into opening 30 of an interior pocket.

Figure 19:
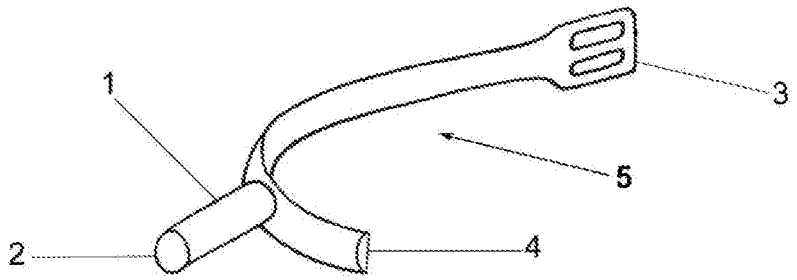
FIG. 19 is a perspective view of a modified spur yoke having only one fastenable free end.

FIG. 19 shows a modified spur yoke 5 with a spur neck 1 and spur tip 2. Yoke 5 includes a fastenable free end 3 and a shorter, non-fastenable free end 4. Yoke 5 is created by simply cutting off a portion of a traditional yoke 10.

Figure 20:
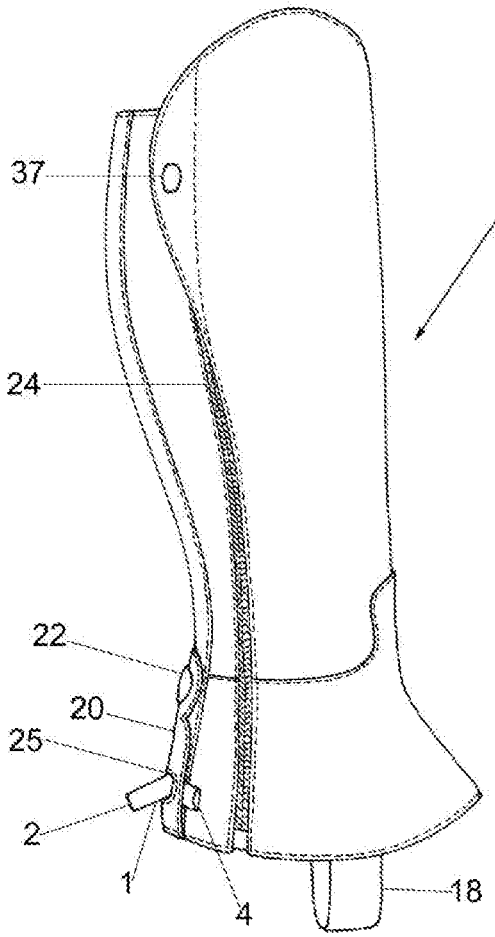
FIG. 20 is a side view of a chap fitted with the modified spur yoke of FIG. 19, in accordance with a tenth embodiment of the invention.

FIG. 20 illustrates a tenth embodiment of the invention, showing a side view of an improved riding chap 616, which includes a footstrap 18, a full-length vertical zipper 24, and only one side pocket (not shown). The top end of zipper 24 is covered by a flap which is fastened by a snap 37. In this embodiment, the modified spur yoke 5 shown in FIG. 9 is used, with the shorter free end 4 of yoke 5 positioned adjacent to the zipper 24, the purpose of which is to enable chap 616 to be removed from a rider's leg without having to remove the spur yoke 5. Backstop 20 includes a snap 22 and aperture 25, which support and secure spur neck 1 and spur tip 2.

Figure 21:
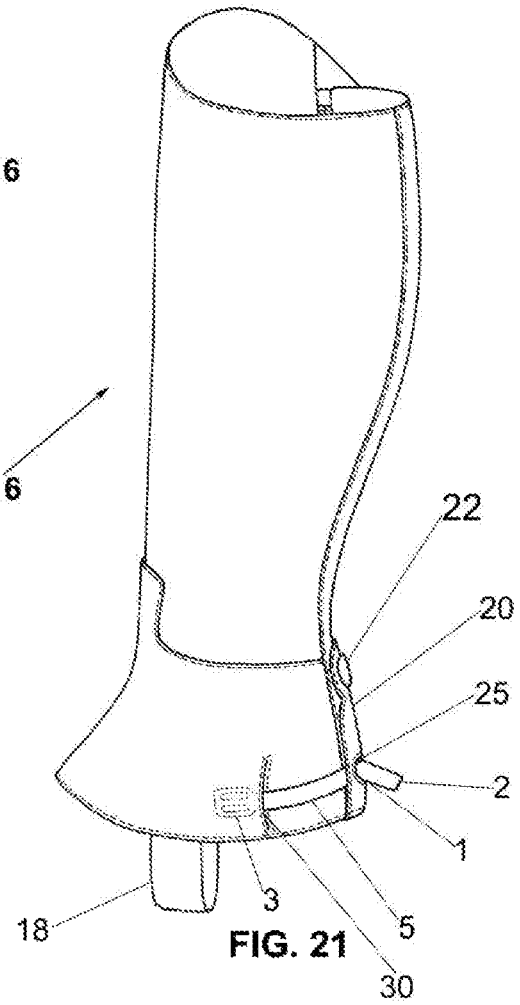
FIG. 21 is an opposite side view of the chap shown in FIG. 20.

FIG. 21 shows a view of the opposite side of chap 616 shown in FIG. 20, including footstrap 18 and an interior pocket with opening 30 into which the longer free end 3 of yoke 5 is inserted. The spur neck 1 and spur tip 2 project through aperture 25 and are secured to chap 616 by backstrap 20 and snap 22.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The invention claimed is:

1. A garment for holding an equestrian riding spur having a spur end and spur neck, comprising:

at least one pocket for holding a free end of a riding spur yoke;

a backstrap having a plurality of apertures through which the spur neck and spur end of a riding spur is configured to project through one of the apertures, and each of the plurality of apertures is connected to another one of the plurality of apertures by a slit in the backstrap for allowing the riding spur's position to be vertically moved to another one of the plurality of apertures; and wherein the backstrap is releasably detachable to the garment allowing the riding spur to be removed from the garment without removal of the garment from the user.

2. The garment of claim 1, wherein the garment is an equestrian riding chap.

3. The garment of claim 1, wherein the backstrap includes one or more releasable fasteners.

4. The garment of claim 1, wherein the backstrap is permanently connected to the garment.

5. The garment of claim 1, wherein the at least one pocket is configured to accommodate spur yoke ends of substantially the same length.

6. The garment of claim 1, wherein the slit is a substantially vertical slit that is smaller in size than each one of the plurality of apertures.

7. A garment for holding an equestrian riding spur having a spur end and spur neck, comprising:

at least one pocket;

for holding a free end of a riding spur yoke to the garment;

a backstrap located at a bottom of the garment having at least one end which is releasably attached to the garment and a plurality of apertures connected by slits through which the spur neck and spur end of a riding spur is configured to project through one of the plurality of apertures and the riding spur is vertically adjustable to another one of the apertures by moving the riding spur through one of the slits; and wherein the at least one pocket and the backstrap are configured to secure the riding spur to the garment such that the spur can quickly be attached to or removed from the garment.

8. The garment of claim 7, wherein the garment is an equestrian riding chap.

9. The garment of claim 7, wherein the slits are vertical slits that are narrower in size than the aperture, where the spur neck is configured to pass though the slit for holding the neck in a fixed position in the aperture.

10. The garment of claim 7, wherein the at least one pocket is configured to accommodate spur yoke ends of substantially the same length.

11. A garment for holding an equestrian riding spur, comprising:

a first pocket and a second pocket located on each respective side of the garment for holding each respective free end of a riding spur yoke;

a backstrap having a plurality of apertures each connected to another one of the plurality of apertures by a slit through which a portion of the spur is configured to project, such that the spur's position can be adjusted by moving the spur to another one of the plurality of apertures though a slit; and wherein the backstrap is releasably detachable to the garment allowing the spur to be removed from the garment without removal of the garment from the user.

12. The garment of claim 11, wherein the slit is smaller in size than each of the plurality of apertures.

13. The garment of claim 11, wherein the garment is an equestrian riding chap.

14. The garment of claim 11, wherein the backstrap includes one or more releasable fasteners.

15. The garment of claim 11, wherein the first pocket and second pocket are configured to accommodate spur yoke ends of substantially the same length.

16. The garment of claim 11, wherein the first pocket and second pocket secure the free end of the riding spur yoke for eliminating the need for an instep strap.

17. The garment of claim 11, wherein the first pocket, second pocket and backstrap integrate the riding spur into the garment for eliminating the need for an instep strap.

* * * * *